US008356565B2

(12) United States Patent
Bierma

(10) Patent No.: US 8,356,565 B2
(45) Date of Patent: Jan. 22, 2013

(54) TENSIONING DEVICE FOR A CARRYING NET

(76) Inventor: Jochum Bierma, Linz (AT)

( * ) Notice: Subject to any disclaimer, the term of this patent is extended or adjusted under 35 U.S.C. 154(b) by 602 days.

(21) Appl. No.: 12/590,168

(22) Filed: Nov. 3, 2009

(65) Prior Publication Data

US 2010/0116187 A1 May 13, 2010

(30) Foreign Application Priority Data

Nov. 10, 2008 (AT) ..... A 1737/2008

(51) Int. Cl.
*B63B 1/10* (2006.01)
*B63B 1/12* (2006.01)

(52) U.S. Cl. ..... 114/61.1; 114/61.23

(58) Field of Classification Search ..... 114/39.11, 114/39.21–39.31, 61.1, 61.23; 482/27–29
See application file for complete search history.

(56) References Cited

U.S. PATENT DOCUMENTS

| | | | | |
|---|---|---|---|---|
| 223,588 | A * | 1/1880 | Hicks | 5/129 |
| 3,593,352 | A * | 7/1971 | Britt | 5/127 |
| 3,796,175 | A | 3/1974 | Ford, Jr. et al. | |
| 4,557,210 | A | 12/1985 | Gerwin | |
| 4,569,301 | A | 2/1986 | Pyburn | |
| 4,621,587 | A | 11/1986 | Pool | |
| 4,813,366 | A | 3/1989 | Elder | |
| 5,540,168 | A * | 7/1996 | Pettus | 114/39.23 |
| 5,630,371 | A * | 5/1997 | Morrelli et al. | 114/61.23 |

FOREIGN PATENT DOCUMENTS

| | | |
|---|---|---|
| DE | 2 236 879 | 4/1973 |
| DE | 10 2007 041 122 | 3/2009 |
| FR | 2749269 A1 * | 12/1997 |

* cited by examiner

*Primary Examiner* — Ajay Vasudeva
(74) *Attorney, Agent, or Firm* — Collard & Roe, P.C.

(57) ABSTRACT

A tensioning device is described for a carrying net (6), in particular between the hulls (1) of a catamaran, the carrying net (6) being fastened in a tensile-resistant manner to two mutually opposing legs of a tensioning frame. In order to attain advantageous tensioning conditions, it is proposed that one of the two legs be mounted, as the tensioning leg (5), in the tensioning frame so as to be rotatable about a pivot shaft (10) which is parallel to its longitudinal axis, the pivot shaft extending, when the carrying net (6) is tensioned, on the net side at a distance from the run-off line (13) of the carrying net (6) from the tensioning leg (5), and that an interlocking means (15) be provided for the tensioning position of the tensioning leg (5).

5 Claims, 4 Drawing Sheets

TENSIONING DEVICE FOR A CARRYING NET

CROSS REFERENCE TO RELATED APPLICATIONS

Applicant claims priority under 35 U.S.C. §119 of Austrian Application No. A 1737/2008 filed on Nov. 10, 2008.

FIELD OF THE INVENTION

The invention relates to a tensioning device for a carrying net, in particular between the hulls of a catamaran, the carrying net being fastened in a tensile-resistant manner to two mutually opposing legs of a tensioning frame.

DESCRIPTION OF THE PRIOR ART

In catamarans, the cradle, which joins the two hulls together, often has at least one carrying net which bridges the gap between the two hulls and is tensioned between mutually opposing legs of a tensioning frame formed by the connecting cradle. This carrying net is connected in a tensile-resistant manner to the mutually opposing tensioning frame legs, wherein the carrying net can be clamped or tied down. This involves laboriously tensioning the carrying net by hand before the net is fastened; this makes an advantageous tensioning force difficult to adhere to. This is particularly important in dismantlable catamarans, because, after all, the cradle joining the two hulls together is generally also dismantled during the dismantling of the catamaran, thus preventing the tensioning frame from performing its task.

The invention is thus based on the object of embodying a tensioning device for a carrying net, in particular between the hulls of a catamaran, in such a way as to allow sufficient tensioning of the carrying net to be ensured without being dependent, with regard to the tensioning of the net, on the manual force applied.

SUMMARY OF THE INVENTION

The invention achieves the object set in that one of the two legs is mounted, as the tensioning leg, in the tensioning frame so as to be rotatable about a pivot shaft which is parallel to its longitudinal axis, the pivot shaft extending, when the carrying net is tensioned, on the net side at a distance from the run-off line of the carrying net from the tensioning leg, and in that an interlocking means is provided for the tensioning position of the tensioning leg.

As a consequence of this measure, the carrying net, which acts on the tensioning leg in a tensile-resistant manner, can be tensioned by simple pivoting of the tensioning leg, without employing much force, because the arrangement of the pivot shaft with respect to the run-off line of the carrying net from the tensioning leg may be selected, in the sense of a leverage ratio, in such a way that the application of an appropriate tensioning moment is ensured by a comparatively low manual force. During tensioning, the rotational movement of the tensioning leg moves the run-off line of the carrying net from the tensioning leg away from the retaining leg, which opposes the tensioning leg; this causes a tensioning of the net, so that the tensioning position of the tensioning leg must merely be secured by an interlocking means.

Although different interlocking means may be used, particularly advantageous design ratios are obtained in that the interlocking means comprises a stop, which is arranged radially set apart from the pivot shaft of the tensioning leg, for the tensioning leg and a lock which is mounted on the tensioning leg in a spring-loaded manner in the interlocking direction and reaches behind the stop in the interlocking position. The stop, which preferably forms a part of the interlocking means, for the pivotable tensioning leg not only defines the tensioning position for the tensioning leg, but may also be used for securing this tensioning position when the lock, which is provided on the tensioning leg, reaches behind this stop, because the tensioning leg can then no longer be pivoted away from the stop. The spring-loading, which acts in the interlocking direction, of the lock secures the interlocking position thereof while at the same time allowing simple unlocking. After all, this merely requires the lock to be moved, counter to the spring-loading, from its interlocking position into a release position. If the lock is embodied as an axially displaceably mounted locking bolt which is oriented substantially radially to the pivot shaft of the tensioning leg, then simple handling conditions are obtained, because the locking bolt must merely be drawn out of the interlocking position counter to the spring force. If appropriate run-on surfaces are provided, the locking bolt can engage automatically when the tensioning leg is pivoted into the tensioning position.

In order to simplify the design, the tensioning leg can have a profile forming a longitudinal groove for receiving an edge portion of the carrying net and two end caps, forming the pivot bearings for the tensioning leg, for the profile, at least one of the end caps being provided with the part of the interlocking means that is associated with the tensioning leg. This measure allows the tensioning leg to be adapted in a simple manner to the respective length of the net in that the profile is cut to length accordingly. The end caps, which can be placed into or onto the profile, have all the design parts that are required for the mounting and interlocking of the tensioning leg in the tensioning frame. These end caps can also close off the groove for receiving the edge strip of the carrying net, so that no additional measures are required for axially securing the carrying net. As, in dismantlable catamarans, the tensioning frame is generally also dismantled, it is advisable to connect the tensioning leg to the tensioning frame in a releasable manner. For this purpose, the pivot bearings in the end caps of the tensioning leg can form open bearing half-shells, allowing simple detachment of the tensioning leg from the stubs of the pivot shaft. In the tensioning position, the bearing half-shells are pulled toward these shaft stubs, thus ensuring a secure hold for the tensioning leg within the tensioning frame.

BRIEF DESCRIPTION OF THE DRAWINGS

The subject-matter of the invention is illustrated by way of example in the drawings, in which.

DESCRIPTION OF THE PREFERRED EMBODIMENT

Figure 1:
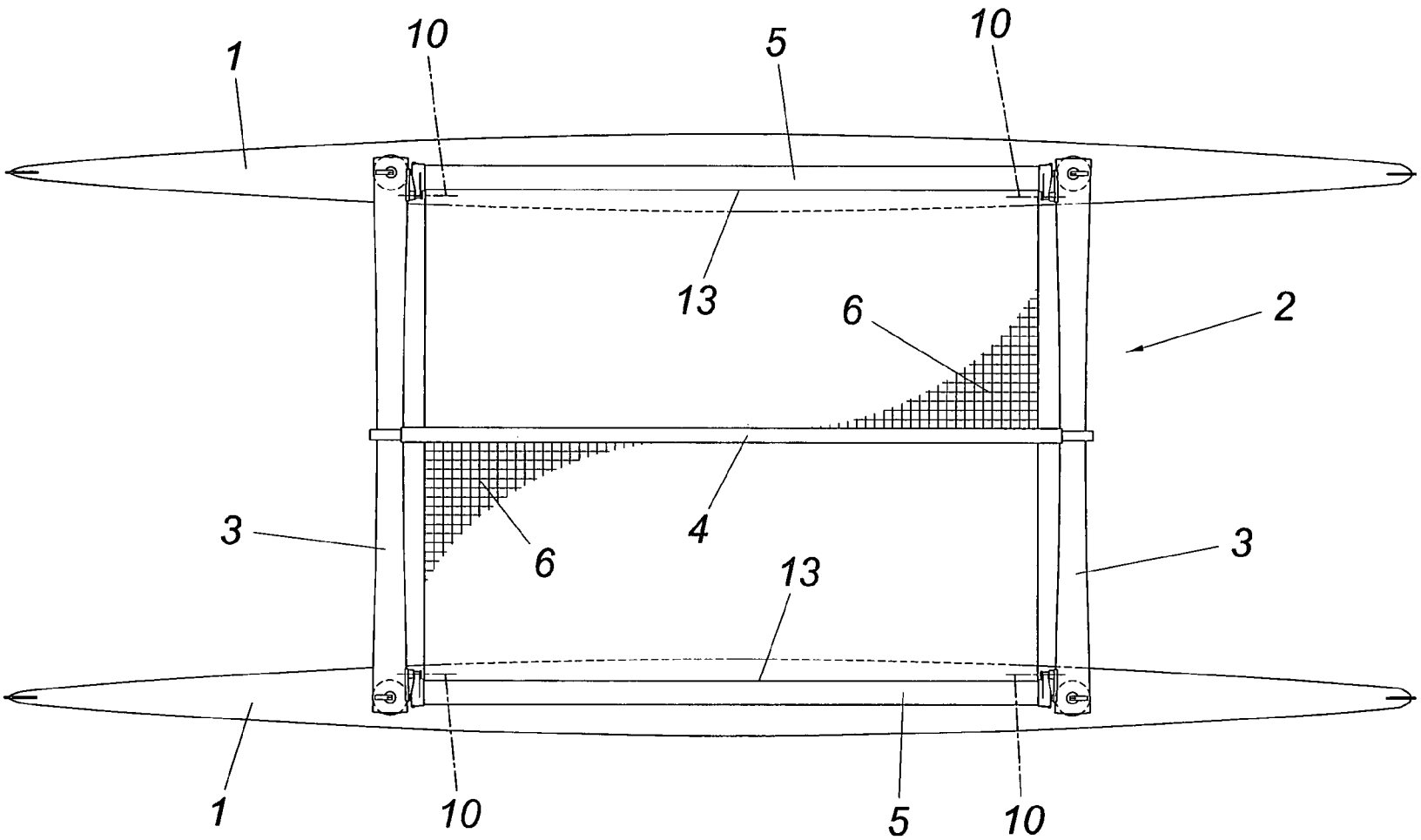
FIG. 1 is a schematic plan view of a dismantlable catamaran with a tensioning device according to the invention for a carrying net located between the hulls.

According to FIG. 1, the illustrated catamaran has two hulls 1 which are releasably joined together by a cradle 2. This cradle 2 has two connecting struts 3 which carry a central longitudinal beam 4 and receive, at the end side, tensioning legs 5 which each form with the longitudinal beam 4 and the connecting struts 3 a tensioning frame for a carrying net 6. The two carrying nets 6 are each connected to the longitudinal beam 4 and the associated tensioning leg 5 in a tensile-resistant manner. The tensioning legs 5 are each composed of a profile 7 and end caps 8 which close off the profile 7 at the end side and form a bearing half-shell 9 for pivotable support on a pivot shaft 10 formed by shaft stubs on the connecting struts 3. The profile 7 comprises a longitudinal groove 11 for receiving an edge portion of the carrying net 6 which is secured in the longitudinal groove 11 by means of a beading 12.

Figure 2:
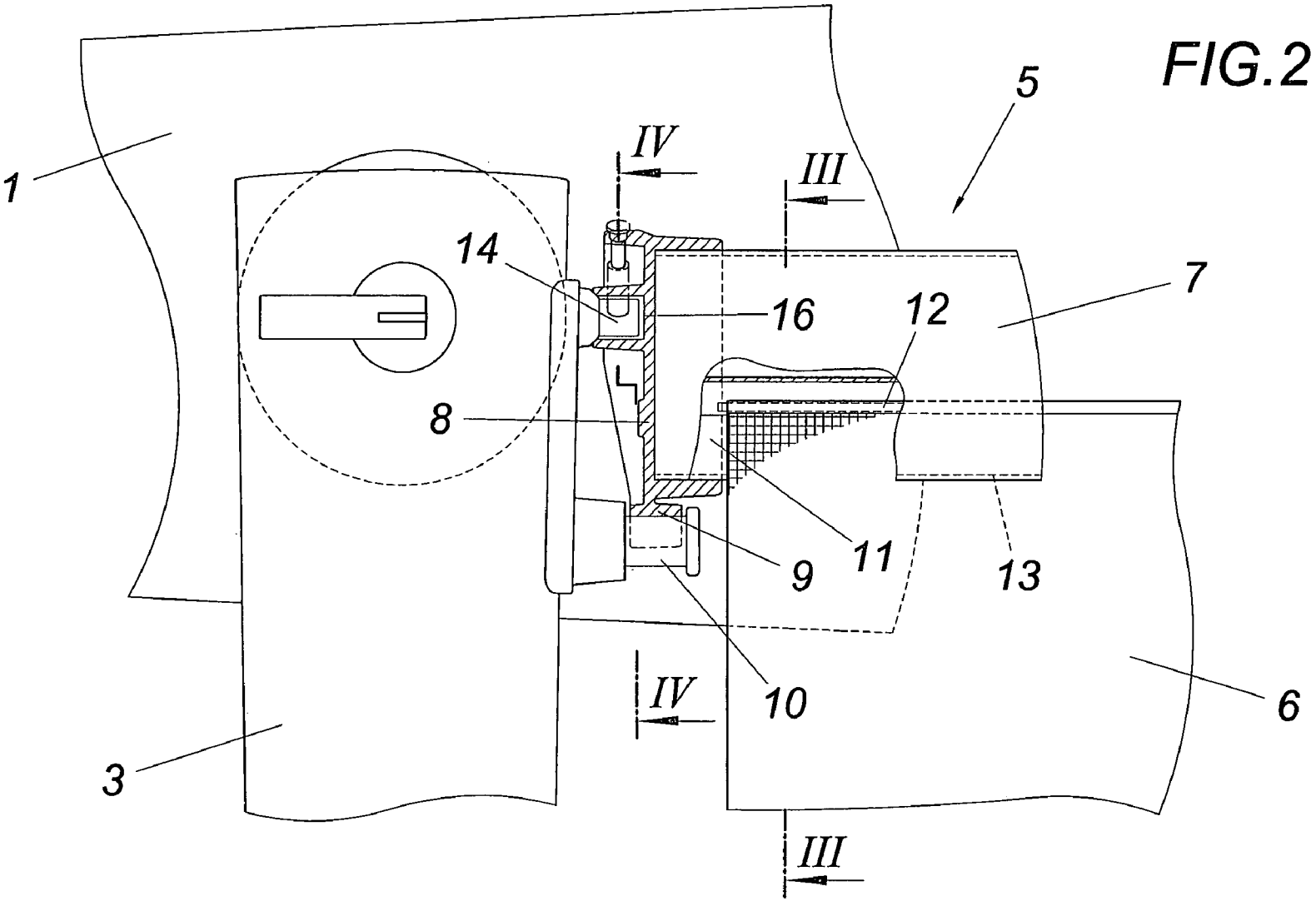
FIG. 2 is an enlarged, partly exploded plan view of certain details of the tensioning frame in the region of a pivot bearing for the tensioning leg.
Figure 3:
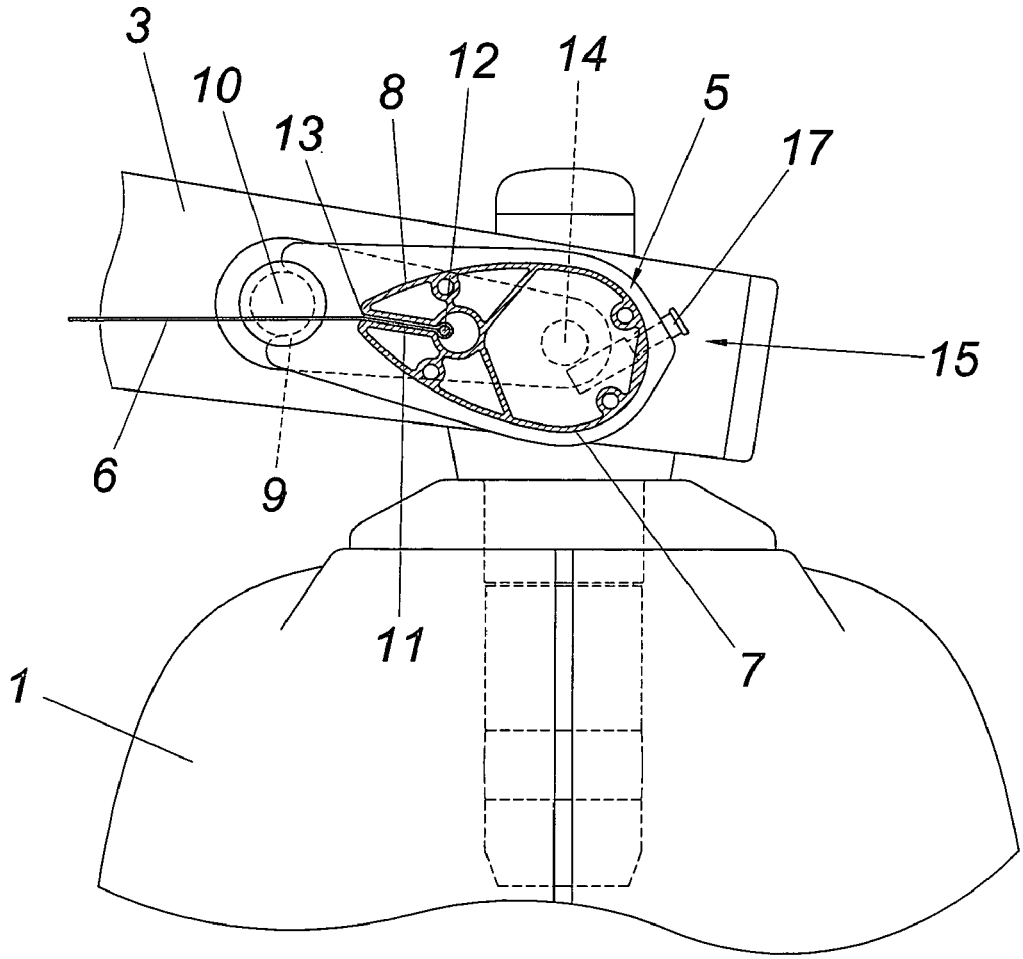
FIG. 3 is a section along the line III-III of FIG. 2.
Figure 4:
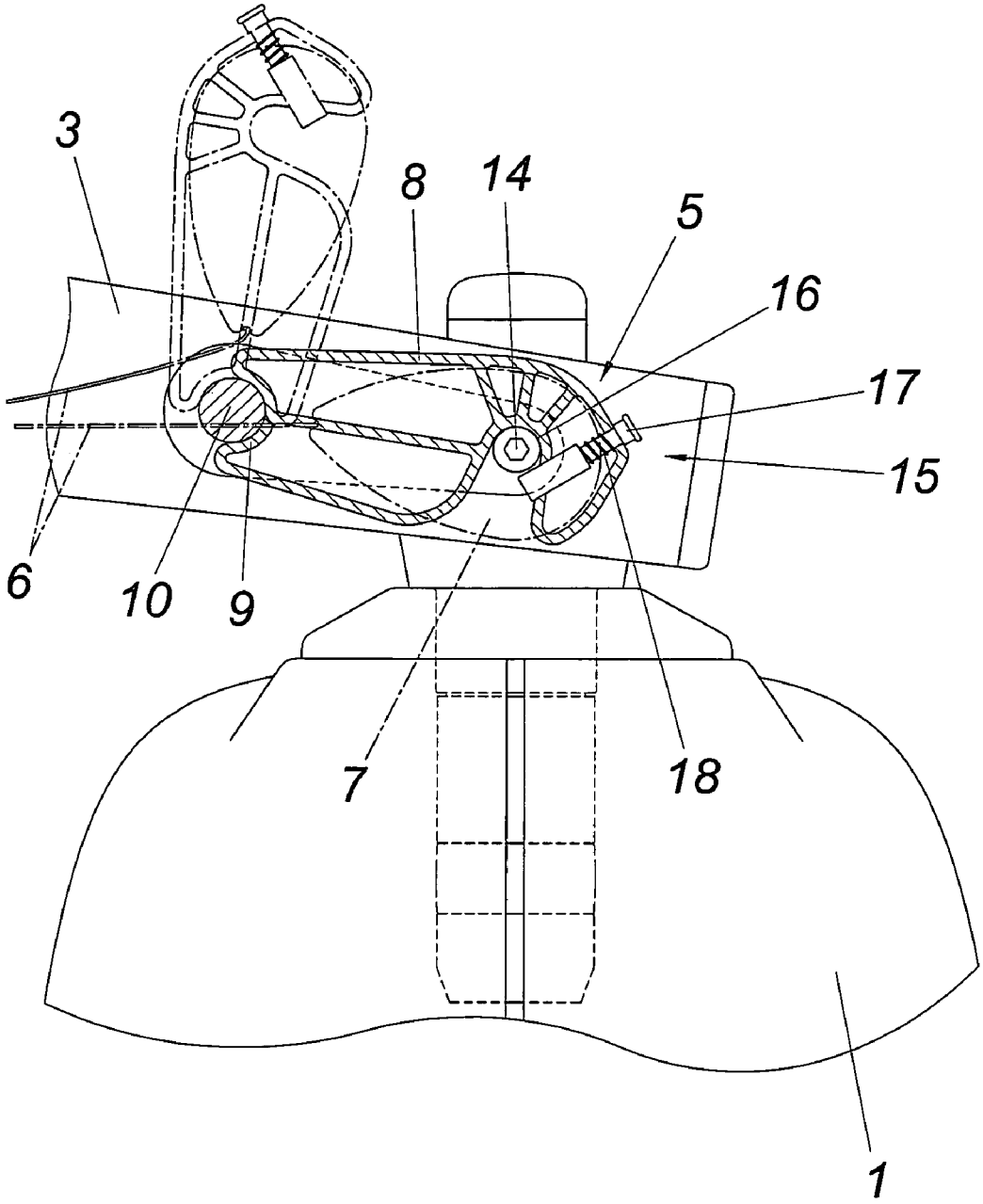
FIG. 4 is a section along the line IV-IV of FIG. 2.

As may be seen in particular from FIGS. 2 and 3, the pivot shaft 10 for the tensioning leg 5 extends on the net side at a distance from the run-off line 13 of the carrying net 6 from the tensioning leg 5, so that, by pivoting the tensioning leg 5 about the pivot shaft 10, the carrying net 6 is, depending on the direction of pivoting, tensioned or loosened, because the run-off line 13 of the carrying net 6 from the tensioning leg 5 moves away from or toward the opposing longitudinal beam 4, as is apparent in FIG. 4 from the tensioning position (illustrated in solid lines) and the relaxation position (indicated in dot-dash lines) for the carrying net 6.

In order to secure the tensioning leg 5 in the tensioning position, the connecting strut 3 is provided with a bolt-like stop 14 for the tensioning leg 5, resting against which the end cap 8 is secured by an interlocking means 15 provided preferably only on one side of the tensioning legs 5, so that unlocking does not require the actuation of two locks 17 which are arranged set far apart from each other at the two ends of the tensioning legs 5. The bolt-like stop 14 engages, in the tensioning position of the tensioning leg 5, with a corresponding receiving recess 16 of the end cap 8 and is secured in this receiving recess 16 with the aid of a spring-loaded lock 17. This lock 17 is embodied, in accordance with the illustrated embodiment, as a locking bolt which is mounted in an axially displaceable manner in the end cap 8 and is pressed into the interlocking position with the aid of an interlocking spring 18, as may be seen in particular from FIG. 4. The lock 17, which is oriented substantially radially to the pivot shaft 10, thus prevents the tensioning leg 5 from pivoting out of its tensioning position, provided that the lock 17 is not drawn out of the interlocking position counter to the force of the interlocking spring 18.

As is immediately apparent from FIG. 4, after the unlocking of the tensioning leg 5 and pivoting thereof out of the tensioning position, which determines a top dead centre position with regard to the tensile forces which occur, the tensioning leg 5 is freed up to be raised from the pivot shaft 10. The two carrying nets 6 can therefore be detached, together with the tensioning legs 5 and the longitudinal beam 4, from the connecting struts 3 in order subsequently to release the connecting struts 3 from the hulls 1. During assembly of the catamaran, the order of the procedure is reversed and, after the hulls 1 have been connected by the connecting struts 3, the longitudinal beam 4 is fastened to the connecting struts 3 before the tensioning legs 5 are placed onto the associated pivot shafts 10 for tensioning the carrying nets 6.

The invention claimed is:

1. Tensioning system for a catamaran, comprising: a carrying net, between opposing hulls of a catamaran, the carrying net being fastened in a tensile-resistant manner to two mutually opposing legs of a tensioning frame, wherein one of the two opposing legs is mounted, as tensioning leg (5), in the tensioning frame so as to be rotatable about a pivot shaft (10) which is parallel to a longitudinal axis of the tensioning leg, the pivot shaft extending, when the carrying net (6) is tensioned, on the side of the net at a distance from a run-off line (13) of the carrying net (6) from the tensioning leg (5), and wherein an interlocking means (15) is provided for the tensioning position of the tensioning leg (5).

2. Tensioning device for a carrying net, between opposing hulls of a catamaran, the carrying net being fastened in a tensile-resistant manner to two mutually opposing legs of a tensioning frame, wherein one of the two opposing legs is mounted, as tensioning leg (5), in the tensioning frame so as to be rotatable about a pivot shaft (10) which is parallel to a longitudinal axis of the tensioning leg, the pivot shaft extending, when the carrying net (6) is tensioned, on the side of the net at a distance from a run-off line (13) of the carrying net (6) from the tensioning leg (5), and wherein an interlocking means (15) is provided for the tensioning position of the tensioning leg (5), wherein the interlocking means (15) comprises a stop (14), which is arranged radially set apart from the pivot shaft (10) of the tensioning leg (5), for the tensioning leg (5) and a lock (17) which is mounted on the tensioning leg (5) in a spring-loaded manner in the interlocking direction and reaches behind the stop (14) in the interlocking position.

3. Tensioning device according to claim 2, wherein the lock (17) is embodied as an axially displaceably mounted locking bolt which is oriented substantially radially to the pivot shaft (10) of the tensioning leg (5).

4. Tensioning device for a carrying net, between opposing hulls of a catamaran, the carrying net being fastened in a tensile-resistant manner to two mutually opposing legs of a tensioning frame, wherein one of the two opposing legs is mounted, as tensioning leg (5), in the tensioning frame so as to be rotatable about a pivot shaft (10) which is parallel to a longitudinal axis of the tensioning leg, the pivot shaft extending, when the carrying net (6) is tensioned, on the side of the net at a distance from a run-off line (13) of the carrying net (6) from the tensioning leg (5), and wherein an interlocking means (15) is provided for the tensioning position of the tensioning leg (5), wherein the tensioning leg (5) has a profile (7) forming a longitudinal groove (11) for receiving an edge portion of the carrying net (6) and two end caps (8), forming pivot bearings for the tensioning leg (5), for the profile (7), at least one of the end caps being provided with the part of the interlocking means (15) that is associated with the tensioning leg (5).

5. Tensioning device according to claim 4, wherein the pivot bearings in the end caps (8) of the tensioning leg (5) form open bearing half-shells (9).

* * * * *